US011730287B1

(12) United States Patent
Kosch

(10) Patent No.: US 11,730,287 B1
(45) Date of Patent: Aug. 22, 2023

(54) SLATWALL ASSEMBLY AND ASSOCIATED METHOD OF INSTALLING THE SAME

(71) Applicant: Paul James Kosch, Spring Lake, MI (US)

(72) Inventor: Paul James Kosch, Spring Lake, MI (US)

( * ) Notice: Subject to any disclaimer, the term of this patent is extended or adjusted under 35 U.S.C. 154(b) by 0 days.

(21) Appl. No.: 17/829,491

(22) Filed: Jun. 1, 2022

(51) Int. Cl.
*A47F 5/08* (2006.01)
*E04F 13/08* (2006.01)

(52) U.S. Cl.
CPC ..... *A47F 5/0846* (2013.01); *E04F 13/0894* (2013.01)

(58) Field of Classification Search
CPC .... A47F 5/0846; A47F 5/0807; A47F 5/0853; A47F 5/0876; E04F 13/0894
USPC ..... 52/36.4, 36.5, 36.6
See application file for complete search history.

(56) References Cited

U.S. PATENT DOCUMENTS 4,292,781 A 10/1981 Chalmers et al.
4,607,753 A 8/1986 Radek
4,694,965 A * 9/1987 Parnell ..... A47F 5/0846 52/36.5
4,961,295 A 10/1990 Kosch, Sr. et al.
D338,076 S 8/1993 Current
5,485,934 A * 1/1996 Holztrager ..... A47F 5/0846 211/126.2
D397,803 S 9/1998 Current
D399,010 S 9/1998 Current
D404,148 S * 1/1999 Laskowski ..... D25/123
5,878,543 A 3/1999 Mowery
5,899,344 A * 5/1999 Current ..... A47F 5/0846 264/45.9
D414,567 S * 9/1999 Burt ..... D25/123
6,325,223 B1 * 12/2001 Hannen ..... A47F 5/0846 211/87.01
6,370,832 B1 4/2002 McGarry et al.
D473,664 S 4/2003 Perkins et al.
6,547,086 B1 4/2003 Harvey
6,971,614 B2 12/2005 Fischer et al.
7,104,023 B1 9/2006 Holztrager
7,198,159 B2 4/2007 Fischer
7,296,695 B2 * 11/2007 Perkins ..... A47F 5/0846 312/249.8
7,464,511 B2 12/2008 Kosch
7,571,571 B1 8/2009 Mershon
D611,272 S 3/2010 Daino
7,717,279 B2 * 5/2010 Lawson ..... A47F 5/0853 211/94.01
D648,448 S * 11/2011 Apgood, II ..... D25/138
8,746,472 B2 * 6/2014 Thrush ..... F16M 13/022 211/94.01

(Continued)

*Primary Examiner* — Brian E Glessner
*Assistant Examiner* — Adam G Barlow
(74) *Attorney, Agent, or Firm* — King & Partners, PLC

(57) ABSTRACT

A slatwall panel assembly that exhibits exceptional strength for holding heavy objects and unprecedented durability for long-term, indoor and/or outdoor use, including: (a) a top starter panel; (b) a first slatwall panel; (c) an optional additional slatwall panel; (d) a bottom finishing panel; (e) wherein the top starter panel is securable to an upper portion of the first slatwall panel; and (f) wherein the bottom finishing panel is securable to a lower portion of the first slatwall panel or a lower portion of the optional additional slatwall panel.

6 Claims, 4 Drawing Sheets

(56) References Cited

U.S. PATENT DOCUMENTS

| | | | | |
|---|---|---|---|---|
| 8,763,312 | B2 * | 7/2014 | Carter | A47B 96/00 52/36.5 |
| D860,479 | S * | 9/2019 | Calmes | D25/125 |
| 10,492,631 | B2 * | 12/2019 | Velderman | H05K 7/183 |
| 10,968,936 | B2 | 4/2021 | Boo et al. | |
| 2005/0127016 | A1 * | 6/2005 | Fischer | A47F 5/0846 211/94.01 |
| 2005/0193641 | A1 * | 9/2005 | Fischer | A47B 96/067 52/36.5 |
| 2006/0091094 | A1 * | 5/2006 | Schuberth | A47F 5/0846 211/94.01 |
| 2008/0000862 | A1 * | 1/2008 | Lawson | A47B 96/14 211/94.01 |
| 2010/0122505 | A1 * | 5/2010 | Jakiel | E04F 13/18 52/762 |
| 2011/0185667 | A1 * | 8/2011 | Carter | E04B 2/46 52/582.1 |
| 2012/0199708 | A1 * | 8/2012 | Convey | E04F 13/081 29/428 |
| 2013/0228294 | A1 | 9/2013 | Aldén | |

* cited by examiner

SLATWALL ASSEMBLY AND ASSOCIATED METHOD OF INSTALLING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to slatwall panel assemblies, and, more particularly, to slatwall panel assemblies that exhibit exceptional strength for holding heavy objects and unprecedented durability for long-term, indoor and outdoor use in extreme conditions (e.g., temperature, humidity, etcetera). The slatwall panel assemblies of the present invention also enable simple and fast installation by a single installer.

The present invention further relates to methods of installing the slatwall panel assemblies disclosed herein.

2. Background Art

Slatwall panels and assemblies have been known in the art for years and are the subject of several patents and publications, including: U.S. Pat. No. 10,968,936 entitled "Panel with a Fastening Device," U.S. Pat. No. 7,571,571 entitled "Slatwall Profile," U.S. Pat. No. 7,464,511 entitled "Slat Wall Assembly," U.S. Pat. No. 7,198,159 entitled "Slatwall Extrusion and Assembly," U.S. Pat. No. 7,104,023 entitled "Wall Organizer," U.S. Pat. No. 6,971,614 entitled "Slatwall Hanger Stabilizing Chip," U.S. Pat. No. 6,547,086 entitled "Display Wall Panel," U.S. Pat. No. 5,899,344 entitled "Extruded Slatwall Section and Method for Making the Same," U.S. Pat. No. 4,961,295 entitled "Metal Slat and Wall System Utilizing Same," and United States Patent Application Publication Number 2013/0228294 entitled "Slat Wall"—all of which are hereby incorporated herein by reference in their entirety including all references cited therein.

U.S. Pat. No. 10,968,936 appears to disclose a set comprising a panel and a fastening device for securing a furniture component, such as a hinge, an interior fitting, a carrying device or a slider, to the panel. The fastening device includes an element with a first element surface comprising a protruding part which protrudes from the first element surface. The panel comprises an edge surface and a panel surface, which includes an insertion groove. The fastening device is configured to be assembled to the panel with the first element surface facing the panel surface. The edge surface includes an edge groove and a flexible tongue that is arranged in the edge groove. The protruding part is configured to be inserted into the insertion groove and includes a recess and the flexible tongue that is configured to cooperate with the recess for locking of the fastening device to the panel.

U.S. Pat. No. 7,571,571 appears to disclose a slatwall profile which comprises an upper male and a lower female end portions for interlocking with adjacent profiles to create a slatwall panel. The female end portion includes an attachment wall for attachment to a wall structure and a downwardly disposed longitudinal groove formed by the attachment wall, a base wall formed with a substantially 90° corner with the attachment wall, and a U-shaped return that forms a lip. The male end portion is receivable into the groove in an adjacent profile. The male end portion includes a cover wall that overlies the attachment wall in a spaced apart relationship. The cover wall includes a bulge for being positioned adjacent the corner and is configured to support the cover wall a distance away from the attachment wall. The male end portion includes a transverse wall extending from the bulge, the transverse wall for overlaying the base wall. The male end portion includes a ramp wall biased against an inner wall of the return, and a distance between an outer edge of the ramp wall and a bottom of the bulge is larger than a corresponding distance within the groove to provide the male end portion a snug fit within the groove.

U.S. Pat. No. 7,464,511 appears to disclose a slat wall assembly that comprises a first slat, an attachment assembly, and a second slat. The first slat includes a body and a lower flange. The body includes an upper edge and a lower edge. The lower flange emanates from the lower edge of the body. The attachment assembly is associable with the lower flange of the first slat and facilitates attachment of the first slat to an existing wall. The second slat includes a body and an upper flange. The body includes an upper edge and a lower edge. The upper flange emanates from the upper edge of the body. The upper flange is configured to be insertable into the lower flange of the first slat and retainable therein.

U.S. Pat. No. 7,198,159 appears to disclose a slatwall extrusion and assembly for a wall of a building to support hangers and shelving and the items they carry. Each section of slatwall has a continuous linear rear wall that integrally joins number of spaced boards. Each board has front, rear, top and bottom walls that form a continuous loop around a hollow interior. Each board also has a downwardly extending double-walled lip. The lip is spaced from its adjacent lower board to form an L-shaped slot. The continuous rear wall is firmly secured to the studs or drywall of the wall by self-tapping screws or an adhesive coating. The linear rear wall, hoop shaped boards, and double-walled lips combine to form a sturdy, lightweight and inexpensive slatwall extrusion. High impact polystyrene (HIPS) is used to achieve even further cost and weight reductions while maintaining the strength of the slatwall extrusion and assembly.

U.S. Pat. No. 7,104,023 appears to disclose a wall organizer that comprises a first slatwall member secured to a wall, the first slatwall member having a plurality of first grooves having a first center-to-center groove spacing between said first grooves; a second slatwall member secured to the wall above or below the first slatwall member, the second slatwall member having a plurality of second grooves having a second center-to-center groove spacing between said second grooves; and at least another first or second slatwall member secured to the wall above or below one of the first and second slatwall members.

U.S. Pat. No. 6,971,614 appears to disclose a removable clip that stabilizes a hanger mounted on a slatwall assembly formed by a number of horizontally aligned and uniformly spaced slats or boards. The upper and lower end of each slat has a lip with an inside surface, so that adjacent slats form a slot with a narrow outer portion and a wider inner portion. The hanger has an upper end that is inserted into an upper slot, and a lower end that hangs down near a lower adjacent slot. The stabilizing clip has a main body and an extending brace. The body is shaped to firmly snap fit into the lower slot. The brace extends upwardly along a middle slat to form a slot for receiving the lower end of the hanger and retaining it against the surface of the middle slat. In a second embodiment, the clip also includes a riser for supporting the lower end of the hanger and positioning the hanger so that its upper end more fully engages the inside surface of the lip of an upper slat.

U.S. Pat. No. 6,547,086 appears to disclose a display wall panel that includes a base member with a horizontal slot having a triangular cross-section. The slot has an upper surface and a lower surface where the surfaces converge toward the opening of the slot. The system also includes a bracket having a curved portion with a top member and a bottom member where the curved portion fits into the slot and the top member bears against the upper surface of the slot and the bottom member bears against the lower surface of the slot. There is also provided a wall panel system which includes a base member with at least one horizontal slot extending therein. The slot has an upper surface, a lower surface, a rear surface, and an opening formed by an upper wall and a lower wall. The system also includes a bracket having a vertical member with a top member, a bottom member, and a curved portion extending outwardly from the vertical member. When the bracket is placed within the slot, the top member bears against the upper surface of the slot, the bottom member bears against the lower surface of the slot, and the curved portion rests on the lower wall of the opening.

U.S. Pat. No. 5,899,344 appears to disclose a slatwall section having a groove formed above and behind the upper most slat for providing additional structural integrity. The formed groove enables a slatwall to be manufactured having uniform thickness. A mating engagement between upper and lower slatwall sections provides a connection point that is concealed within a formed slat, and thereby eliminates the use of exteriorly disposed sink holes or fasteners.

U.S. Pat. No. 4,961,295 appears to disclose a slatted wall or panel assembly which may be easily assembled and possesses substantial structural rigidity as well as an attractive appearance, which includes a plurality of structurally-supportive backing members having a plurality of mutually-spaced protruding ears which are generally rigid and which form load-bearing slat supports, and further includes a plurality of slats which are mounted upon the backing member by hanging the slats upon the load-bearing ears in interlocked relation with the ears and with adjacent slats by means of flanged edge extremities extending along each slat. Each pair of adjacent slats collectively defines an L-shaped recess which is adapted to receive therein a substantially L-shaped arm of a display shelf, hook, etc., for mounting display item upon the assembly. The slats are configured to permit manufacture by roll-forming bending operations such that the slats may be of sheet metal construction and economically manufactured in quantity.

United States Patent Application Publication Number 2013/0228294 appears to disclose a slat wall formed as a three dimensional body with a predetermined height, width and thickness. The slat wall of the invention comprises a core, presenting a first and a second: face and at least one groove extending inwardly from the first face of the core and having a length extending in the direction of the width of the slat wall. An insert comprising at least one wall which defines a cavity, is arrange in said groove, and at least: one covering layer covers the first lace of the core and a part of the groove. The slat wall further comprises a slit miming through the covering layer and through the wall of the; insert, which slit has an extension in the direction of the width of the slat wall. The slat wall of the invention is easy to handle and simple to manufacture. The design of the slat wall enables the manufacturing of a receiving groove with a T-shaped profile without the need to mill out such a profile in the core. In this way, use of all kinds of materials, such as light-weight boards are made possible.

While the above-identified patents and publications do appear to disclose various slatwall panels and assemblies, their configurations remain non-desirous and/or problematic inasmuch as, among other things, none of the above-identified slatwall panel assemblies exhibit exceptional strength for holding heavy objects and unprecedented durability for long-term, indoor and outdoor use in extreme conditions (e.g., temperature, humidity, etcetera). Moreover, none of the above-identified patents or publications disclose a slatwall assembly that enables simple and fast installation by a single installer as disclosed herein.

These and other objects of the present invention will become apparent in light of the present specification, claims, and drawings.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The present invention is directed to a slatwall panel assembly that exhibits exceptional strength for holding heavy objects and unprecedented durability for long-term, indoor and/or outdoor use, comprising, consisting essentially of and/or consisting of: (a) a top starter panel; (b) a first slatwall panel; (c) a bottom finishing panel; (d) wherein the top starter panel is securable to an upper portion of the first slatwall panel; and (e) wherein the bottom finishing panel is securable to a lower portion of the first slatwall panel or a lower portion of an additional slatwall panel.

In a preferred embodiment of the present invention, the top starter panel includes a body having a top, a bottom, an outer surface, an inner surface, a slot, a mounting tab, a first channel, and a second channel formed in cooperation with the first slatwall panel.

In another preferred embodiment of the present invention, the top starter panel comprises the cross-section provided in FIG. 3 herein.

In yet another preferred embodiment of the present invention, the first slatwall panel includes a body having a top, a bottom, an outer surface, an inner surface, a slot, a mounting tab, a first channel, a second channel, and a third channel formed in cooperation with an additional slatwall panel.

In a preferred implementation of the present invention, the first slatwall panel comprises the cross-section provided in FIG. 3 herein.

In another preferred implementation of the present invention, the bottom finishing panel includes a body having a top, a bottom, an outer surface, an inner surface, and a first channel.

In yet another preferred implementation of the present invention, the bottom finishing panel comprises the cross-section provided in FIG. 3 herein.

In a preferred embodiment of the present invention, the top starter panel and the first slatwall panel are secured to a substrate (e.g., drywall, stud(s), underlayment, backerboard, plywood, particle board, vertical walls, siding, concrete walls, brick walls, etcetera) via fasteners (e.g., threaded fasteners, non-threaded fasteners, bolts, rods, nails, screws, adhesives, etcetera).

In another preferred embodiment of the present invention, the top starter panel, the first slatwall panel and/or the bottom finishing panel are independently fabricated from a material selected from the group consisting of a metal, a metal alloy, a natural resin, a synthetic resin, a plastic, a composite, and/or wood.

The present invention is also directed to a slatwall panel assembly that exhibits exceptional strength for holding heavy objects and unprecedented durability for long-term, indoor and/or outdoor use, comprising, consisting essentially of and/or consisting of: (a) a top starter panel; (b) a first slatwall panel; (c) a second slatwall panel; (d) an optional additional slatwall panel; (e) a bottom finishing panel; (f) wherein the top starter panel is securable to an upper portion of the first slatwall panel; and (g) wherein the bottom finishing panel is securable to a lower portion of the first slatwall panel, a lower portion of the second slatwall panel or a lower portion of the additional slatwall panel.

The present invention is further directed to a slatwall panel comprising, consisting essentially of and/or consisting of: a body having a top, a bottom, an outer surface, an inner surface, a slot, a mounting tab, a first channel, a second channel, and a third channel formed in cooperation with an additional slatwall panel.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
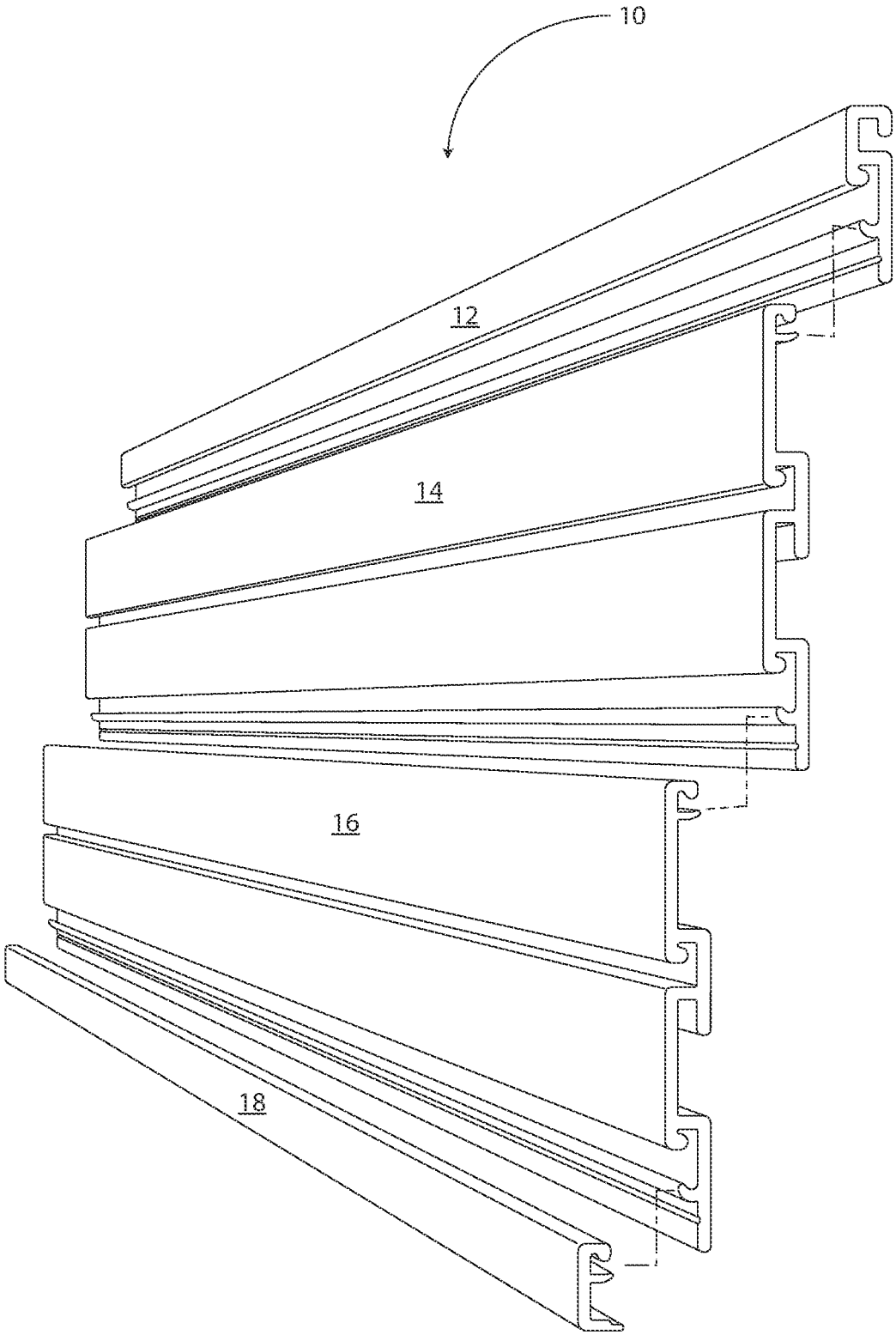
Figure 2:
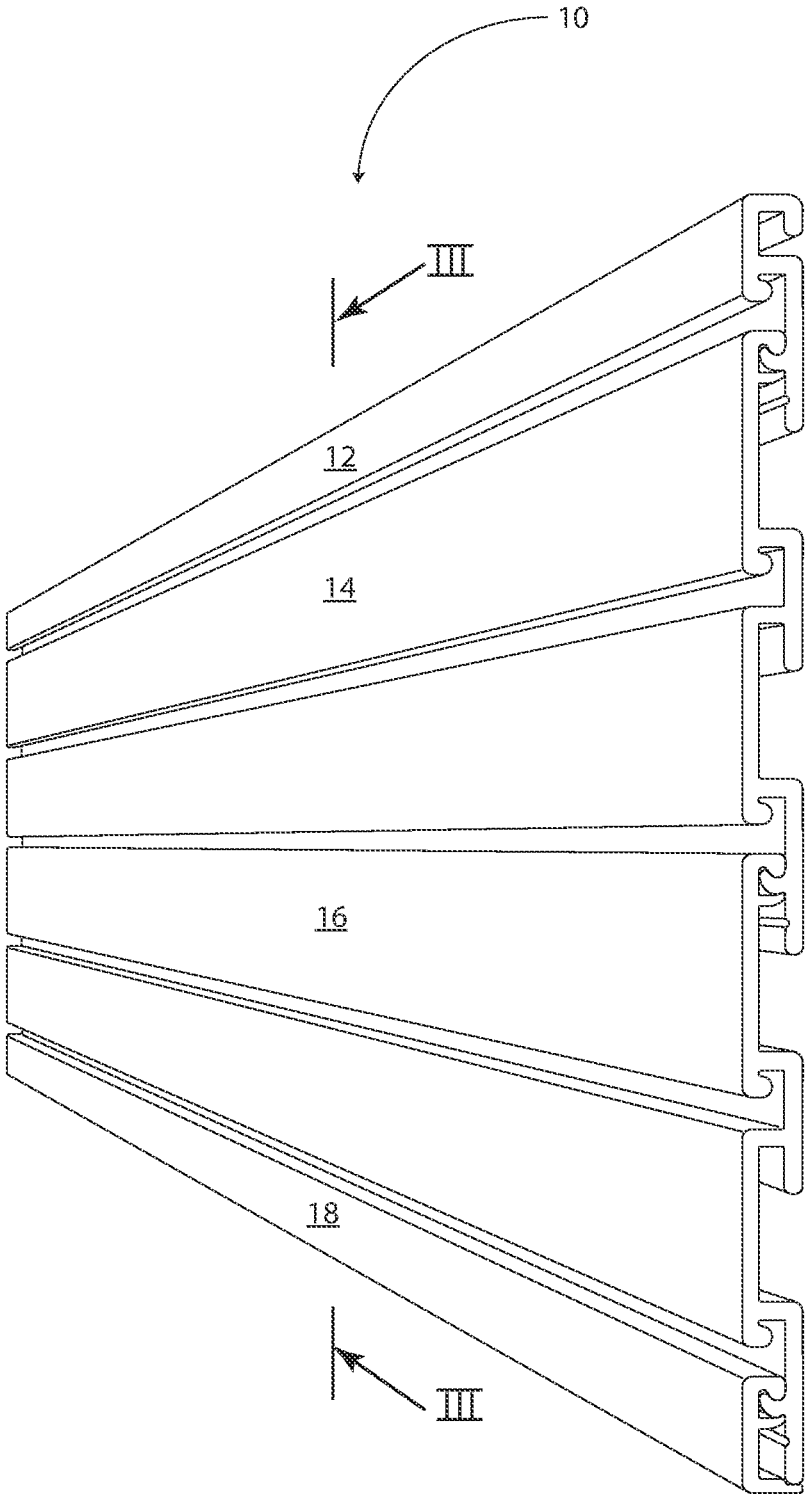
Figure 3:
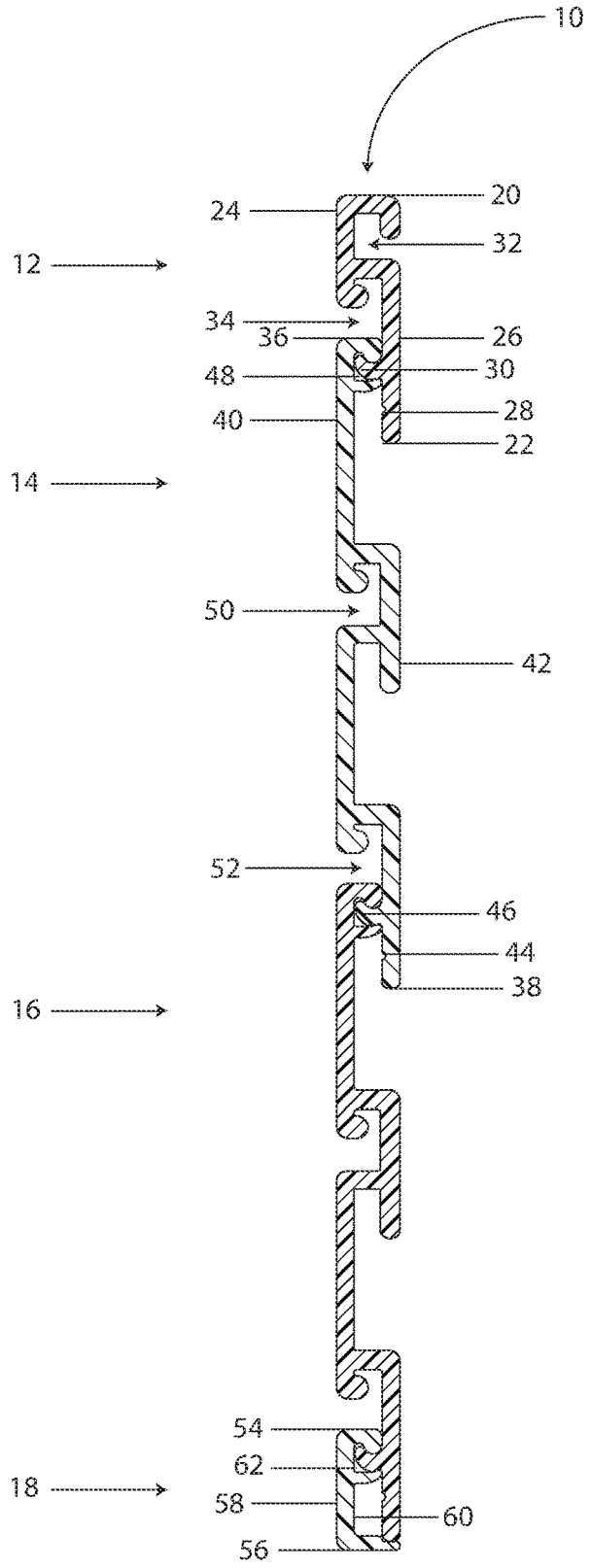
Figure 4:
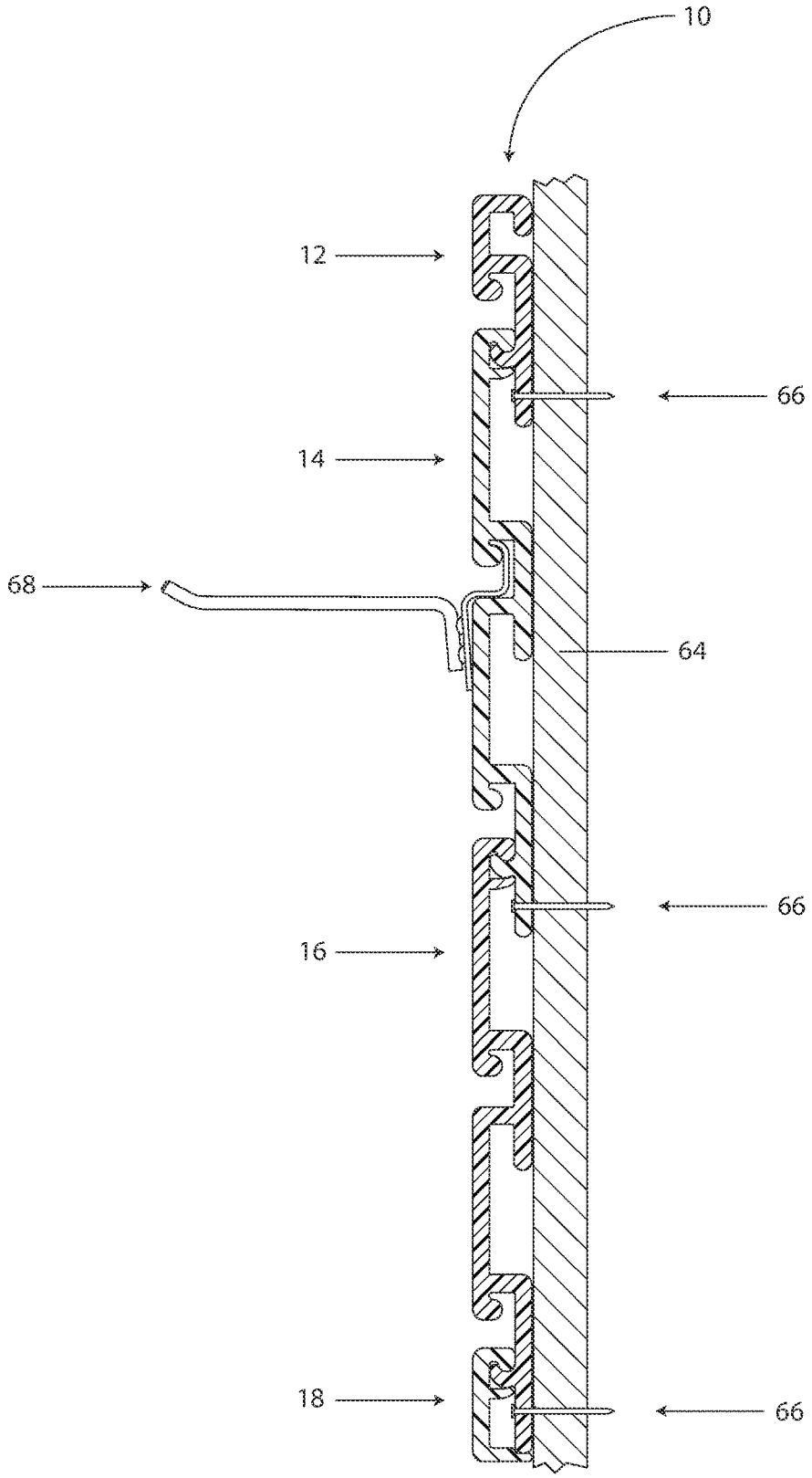

The invention will now be described with reference to the drawings wherein:

FIG. 1 of the drawings is an unassembled perspective view of a first embodiment of a slatwall assembly manufactured in accordance with the present invention;

FIG. 2 of the drawings is an assembled perspective view of the slatwall assembly of FIG. 1;

FIG. 3 of the drawings is a cross-sectional view of the slatwall assembly taken along line III of FIG. 2; and FIG. 4 of the drawings is a cross-sectional view of the slatwall assembly of FIG. 1 mounted to a substrate having an accessory item secured thereto.

DETAILED DESCRIPTION OF THE INVENTION

While this invention is susceptible of embodiment in many different forms and applications, there are shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIGS. 1-3 in particular, a first embodiment of slatwall panel assembly 10 is shown as generally comprising top starter panel 12, first slatwall panel 14, second and/or optional additional slatwall panel 16, and bottom finishing panel 18. Top starter panel 12 is releasably securable to an upper portion of first slatwall panel 14, and bottom finishing panel 18 is releasably securable to a lower portion of first slatwall panel 14 or a lower portion of optional additional slatwall panel 16.

Top starter panel 12 preferably includes a body having top 20, bottom 22, outer surface 24, inner surface 26, slot 28 (for directing screws), mounting tab 30 (e.g., male portion), first channel 32, and second channel 34 formed in cooperation with first slatwall panel 14.

First slatwall panel 14 preferably includes a body having top 36, bottom 38, outer surface 40, inner surface 42, slot 44, mounting tab 46 (e.g., male portion), first channel 48 (e.g., female portion), second channel 50 (e.g., female portion), and third channel 52 (e.g., female portion) formed in cooperation with optional additional slatwall panel 16.

Optional additional slatwall panel 16 is configured the same as first slatwall panel 14. As such, the slatwall panel assembly may comprise any one of a number of slatwall panels (e.g., 1, 2, 3, 4, 5, 6, 7, 8, 9, 10, 15, 20, 50, 100, etcetera).

Bottom finishing panel 18 preferably includes a body having top 54, bottom 56, outer surface 58, inner surface 60, and first channel 62 (e.g., female portion). The bottom surface of this finishing panel is preferably stepped so that it is frictionally secured (or snap fit) with the lowest of the slatwall panels.

In accordance with the present invention, starter panel 12, slatwall panel 14, additional slatwall panel 16, and finishing panel 18 can come in any one of a number of lengths, such as 1 ft, 2 ft, 3 ft, 4 ft, 5 ft, 6 ft, 7 ft, 8 ft, 9 ft, 10 ft, 11 ft, 12 ft, 13 ft, 14 ft, 15 ft, 16 ft, 17 ft, 18 ft, 19 ft, 20 ft, 25 ft, 50 ft, 100 ft, etcetera or any length therebetween—just to name a few.

As is best shown in FIG. 4, top starter panel 12, first slatwall panel 14, optional and/or additional slatwall panel 16 are preferably secured to substrate 64 via fasteners 66. The slots help facilitate initial positioning of fasteners 66 during installation. Accessory item 68 (e.g., hooks, brackets, bins, rods, clamps, etcetera) is frictionally secured into a selected and/or preferred channel. Notably, the curved top of the accessory item engages the channel such that the accessory item cannot slide or otherwise move during normal use. In one embodiment, the curved top of the accessory item slightly carves into the channel of the panel and modifies its structure/shape.

In a preferred embodiment of the present invention, the top starter panel, the first slatwall panel, any additional slatwall panels, and the bottom finishing panel are independently fabricated from a material selected from the group consisting of a metal, a metal alloy, a natural resin, a synthetic resin, a plastic, a composite, and/or wood.

In a preferred operation, the first step of installing the slatwall assembly comprises aligning and securing the top starter panel to a substrate with one or more fasteners or adhesive. If no starter panel is used, then the first slatwall panel may initiate the installation. Next, the first slatwall panel is frictionally and releasably secured (e.g., snap fit) to the starter panel. Then, the first slatwall panel is secured to the substrate with one or more fasteners or adhesive. This allows an installer to quickly build a wall from top to bottom by adding additional slatwall panels until the wall has a desired height. This step is repeated until the size (e.g., height and width) of the wall is established. Lastly, the installer can frictionally snap fit one or more finishing panels to the lower slatwall panels for the cleanest installation.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. A slatwall panel assembly, comprising:

a top starter panel, wherein the top starter panel includes a body having a top surface, a bottom surface, an outer surface, an inner surface, a slot, a mounting tab, a first channel, and a second channel formed in cooperation with a first slatwall panel, and wherein the top surface and the bottom surface of the top starter panel are parallel to each other and orthogonal to the inner surface of the top starter panel, and wherein the slot of the top starter panel is positioned below the mounting tab of the top starter panel;

wherein the first slatwall panel includes a body having a top surface, a bottom surface, an outer surface, an inner surface, a slot, a mounting tab, a first channel, wherein the first channel is the uppermost channel of the first slatwall panel, a second channel, wherein the second channel is outwardly facing, and a third channel formed in cooperation with an additional slatwall panel, and wherein the top surface and the bottom surface of the first slatwall panel are parallel to each other and orthogonal to the inner surface of the first slatwall panel, and wherein the slot of the first slatwall panel is positioned below the mounting tab of the first slatwall panel;

a bottom finishing panel, wherein the bottom finishing panel includes a body having a top surface, a bottom surface, an outer surface, an inner surface, and a first channel, and wherein the top surface and the bottom surface of the bottom finishing panel are parallel to each other and orthogonal to the outer surface of the bottom finishing panel; and wherein the top starter panel is securable to an upper portion of the first slatwall panel, and wherein the bottom finishing panel is securable to a lower portion of the first slatwall panel or a lower portion of an additional slatwall panel, and wherein the mounting tab of the top starter panel is outwardly facing and contacts the first uppermost channel of the first slatwall panel.

2. The slatwall panel assembly according to claim 1, wherein the top starter panel and the first slatwall panel are secured to a substrate via fasteners.

3. The slatwall panel assembly according to claim 1, wherein the top starter panel is fabricated from a material selected from the group consisting of a metal, a metal alloy, a natural resin, a synthetic resin, a plastic, a composite, and/or wood.

4. The slatwall panel assembly according to claim 1, wherein the first slatwall panel is fabricated from a material selected from the group consisting of a metal, a metal alloy, a natural resin, a synthetic resin, a plastic, a composite, and/or wood.

5. The slatwall panel assembly according to claim 1, wherein the bottom finishing panel is fabricated from a material selected from the group consisting of a metal, a metal alloy, a natural resin, a synthetic resin, a plastic, a composite, and/or wood.

6. A slatwall panel assembly, comprising:

a top starter panel, wherein the top starter panel includes a body having a top surface, a bottom surface, an outer surface, an inner surface, a slot, a mounting tab, a first channel, and a second channel formed in cooperation with a first slatwall panel, and wherein the top surface and the bottom surface are parallel to each other and orthogonal to the inner surface, and wherein the slot is positioned below the mounting tab;

wherein the first slatwall panel includes a first channel, wherein the first channel is the uppermost channel of the first slatwall panel, a second channel, wherein the second channel is outwardly facing;

a second slatwall panel;

an optional additional slatwall panel;

a bottom finishing panel; and wherein the top starter panel is securable to an upper portion of the first slatwall panel, and wherein the bottom finishing panel is securable to a lower portion of the first slatwall panel, a lower portion of the second slatwall panel or a lower portion of the additional slatwall panel, and wherein the mounting tab of the top starter panel is outwardly facing and contacts the first uppermost channel of the first slatwall panel.

* * * * *